US007395991B2

(12) United States Patent
Kuo

(10) Patent No.: US 7,395,991 B2
(45) Date of Patent: Jul. 8, 2008

(54) AUTOMATIC SUPPORT MECHANISM AND USE THEREOF

(75) Inventor: Ying-Hsien Kuo, Taipei (TW)

(73) Assignee: QISDA Corporation, Taoyuan (TW)

( * ) Notice: Subject to any disclaimer, the term of this patent is extended or adjusted under 35 U.S.C. 154(b) by 377 days.

(21) Appl. No.: 10/974,404

(22) Filed: Oct. 27, 2004

(65) Prior Publication Data

US 2005/0092885 A1 May 5, 2005

(30) Foreign Application Priority Data

Oct. 30, 2003 (TW) ..... 92130197 A

(51) Int. Cl.
*F16M 13/00* (2006.01)

(52) U.S. Cl. ..... 248/125.9; 248/292.12

(58) Field of Classification Search ..... 248/125.9, 248/286.1, 291.1, 292.12, 676
See application file for complete search history.

(56) References Cited

U.S. PATENT DOCUMENTS 5,797,568 A * 8/1998 Canton Gongora et al. ..... 248/122.1
6,296,217 B1 * 10/2001 Ikedo et al. ..... 248/292.12
6,604,722 B1 * 8/2003 Tan ..... 248/276.1
6,827,409 B2 * 12/2004 Michael ..... 312/223.3
6,880,792 B2 * 4/2005 Muir ..... 248/276.1
7,065,835 B2 * 6/2006 Kuramochi ..... 16/357

FOREIGN PATENT DOCUMENTS

TW 312974 8/1997

* cited by examiner

*Primary Examiner*—Korie Chan
*Assistant Examiner*—Steven Marsh
(74) *Attorney, Agent, or Firm*—Quintero Law Office

(57) ABSTRACT

An automatic support mechanism. The automatic support mechanism includes a fixed base, a first supporting member, a second supporting member and an extendable supporting member. The first supporting member is rotatably connected to the fixed base. The second supporting member is rotatably connected to the fixed base and is slidably connected to the first supporting member. The extendable supporting member is movably disposed between the first supporting member and the second supporting member. The extendable supporting member automatically moves between a received position and an extended position by relative rotation and sliding of the first and second supporting members.

12 Claims, 7 Drawing Sheets

AUTOMATIC SUPPORT MECHANISM AND USE THEREOF

BACKGROUND OF THE INVENTION

1. Field of the Invention

The present invention relates to an automatic support mechanism, and in particular to an automatic support mechanism that is easy to operate.

2. Description of the Related Art

A printer or business machine usually includes a feeding device to input media sheets thereto. The media sheets are placed on a support mechanism of the feeding device and are input to the printer or business machine to be printed or processed.

The conventional support mechanism usually includes multiple extension plates to support the media sheets. The extension plates provide sufficient support area for the media sheets. Nevertheless, extending or rotating a conventional support mechanism requires several steps and may be considered inconvenient.

Hence, there is a need to provide an automatic support mechanism. The present automatic support mechanism can automatically extend or retract without requiring numerous complex steps, thus simplifying operation.

SUMMARY OF THE INVENTION

Accordingly, an object of the invention is to provide an automatic support mechanism comprising a fixed base, a first supporting member, a second supporting member and an extendable supporting member. The first supporting member is rotatably connected to the fixed base. The second supporting member is rotatably connected to the fixed base and is slidably connected to the first supporting member. The extendable supporting member is movably disposed between the first supporting member and the second supporting member. The extendable supporting member automatically moves between a received position and an extended position by relative rotation and slide of the first and second supporting members.

The automatic support mechanism further comprises a guiding member disposed on the second supporting member and having a guiding portion and a first toothed portion.

The first supporting member further comprises a sliding portion and the second supporting member further comprises a sliding groove and a gear set. The guiding portion of the guiding member pivots to the sliding portion and slides in the sliding groove. The first toothed portion of the guiding member engages the gear set.

The extendable supporting member further comprises a guiding groove and a second toothed portion formed therein. The gear set of the second supporting member is in the guiding groove and engages the second toothed portion. The extendable supporting member moves between the received position and the extended position by transmission of the guiding member and gear set.

The gear set further comprises a first gear and a second gear coaxially connected thereto. The first toothed portion of the guiding member engages the first gear, and the second toothed portion of the guiding groove engages the second gear. The first and second gears are formed integrally.

The teeth and diameter of the first gear are smaller than those of the second gear.

The first toothed portion of the guiding member is a continuous toothed strip or rack.

The second toothed portion of the guiding groove is a continuous toothed strip or rack.

The first supporting member further comprises a first end and a second end and the second supporting member further comprises a third end and a fourth end. The first and third ends are connected to the fixed base. The sliding portion is formed on the second end, and the sliding groove is formed on the fourth end. The first end is separated from the third end by a predetermined distance.

The received position is between the first supporting member and the second supporting member.

The extended position is outside the first and second supporting members.

An object of the invention is to provide an extension method of the automatic support mechanism. The extension method comprises the step of rotating the first and second supporting members in a first direction such that the first supporting member rotates relative to the second supporting member and slides thereon in a second direction, and the extendable supporting member moves to an extended position from a received position in a third direction.

Another object of the invention is to provide a retraction method of the automatic support mechanism. The retraction method comprises the step of rotating the first and second supporting members in a fourth direction such that the first supporting member rotates relative to the second supporting member and slides thereon in a third direction, and the extendable supporting member moves to a received position from an extended position in a second direction.

Yet another object of the invention is to provide an operation method of the automatic support mechanism. The operation method comprises the steps of rotating the first and second supporting members in a first direction such that the first supporting member rotates relative to the second supporting member and slides thereon in a second direction, and the extendable supporting member moves to an extended position from a received position in a third direction; and rotating the first and second supporting members in a fourth direction such that the first supporting member rotates relative to the second supporting member and slides thereon in the third direction, and the extendable supporting member moves to the received position from the extended position in the second direction.

The rotating axle of the first supporting member is separated from that of the second supporting member by a predetermined distance.

The second direction is opposite to the third direction.

The first direction is opposite to the fourth direction.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
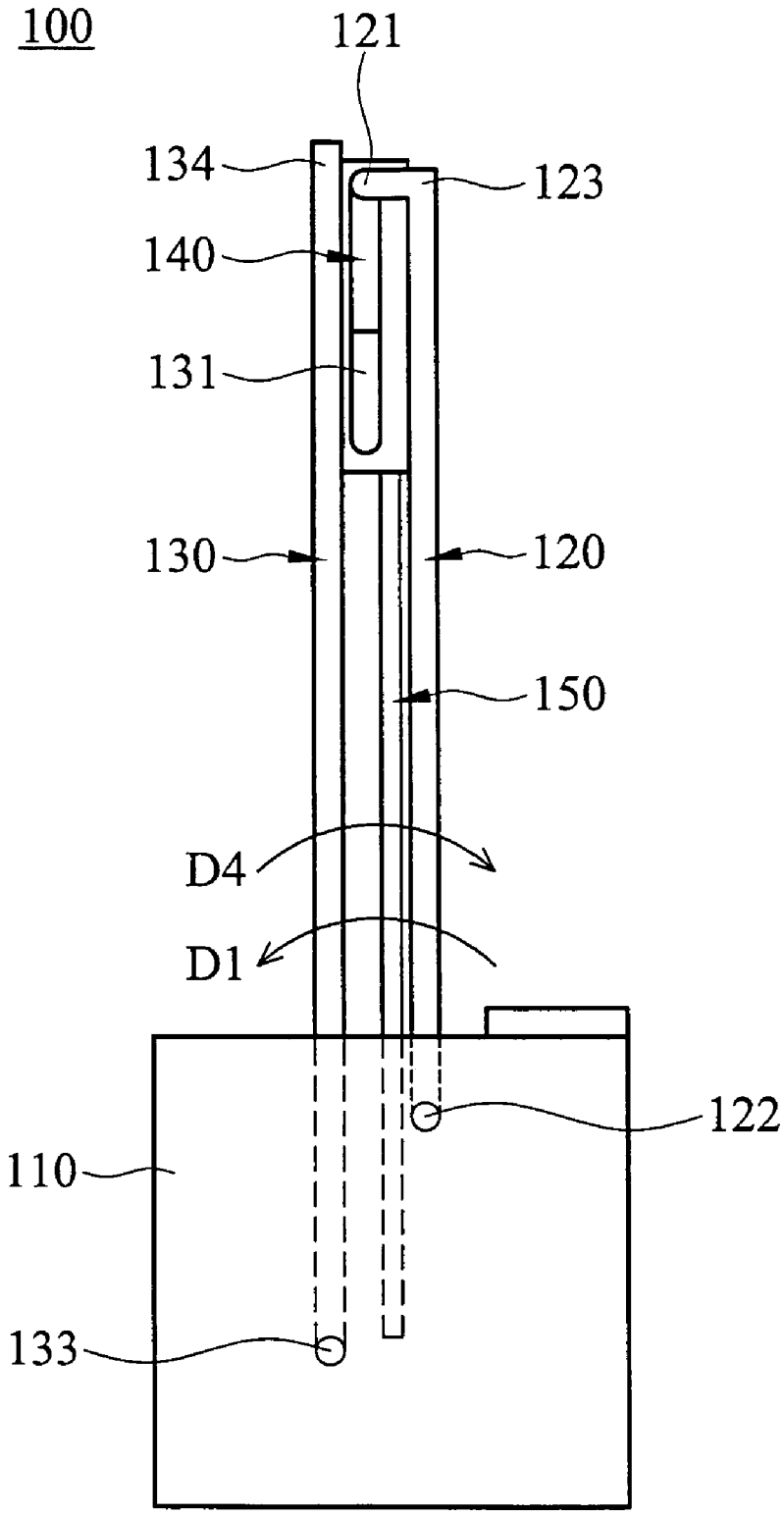
FIG. 1 is a schematic side view showing the automatic support mechanism of the invention in a received position.
Figure 2:
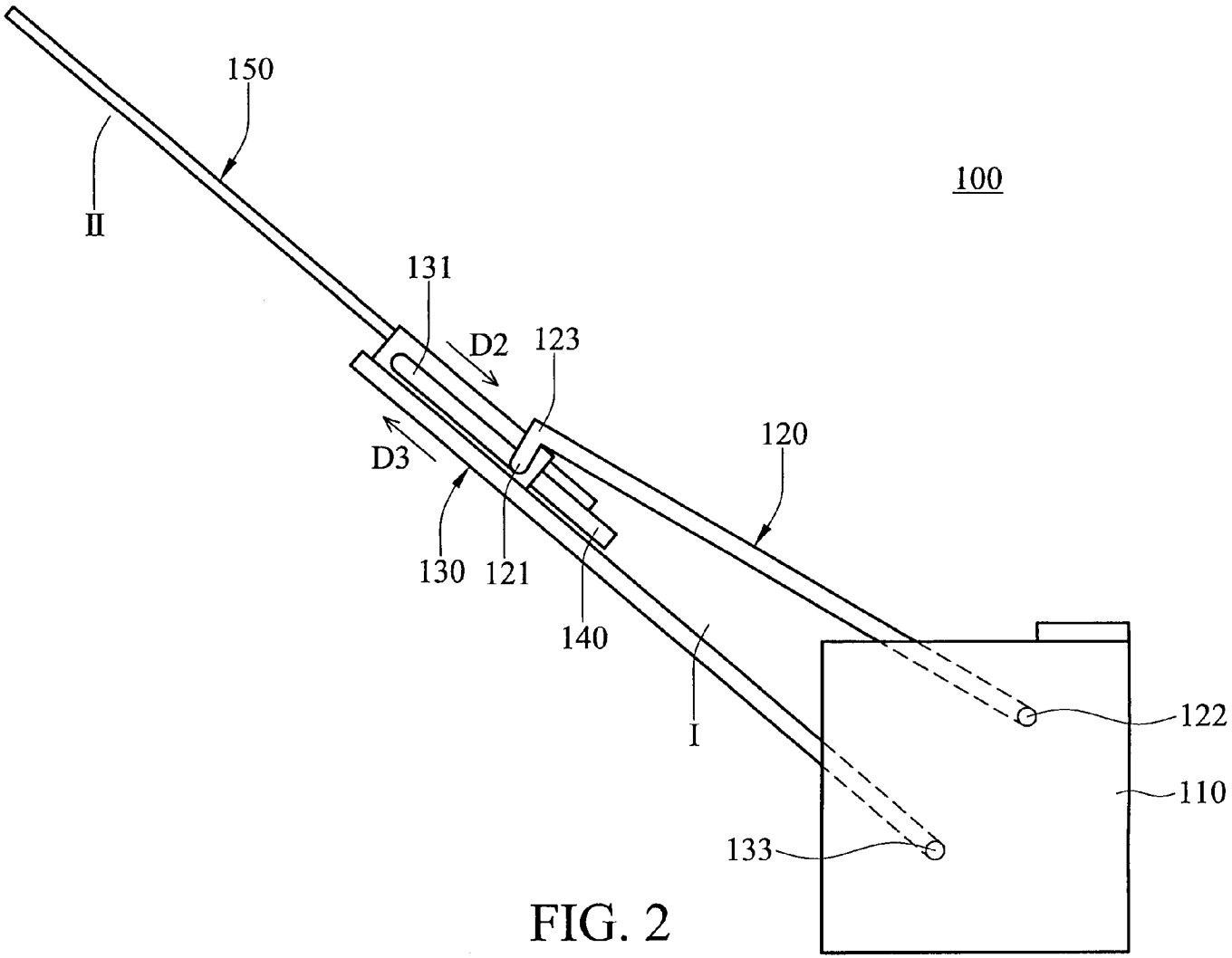
FIG. 2 is a schematic side view showing the automatic support mechanism of the invention in an extended position.

Referring to FIG. 1 and FIG. 2, the automatic support mechanism 100 is employed in a printer or business machine to support media sheets and comprises a fixed base 110, a first supporting member 120, a second supporting member 130, a guiding member 140 and an extendable supporting member 150.

The first supporting member 120 is rotatably connected to the fixed base 110 and has a sliding portion 121. Specifically, the first supporting member 120 has a first end 122 and a second end 123. The first end 122 is rotatably connected to the fixed base 110. The sliding portion 121 is formed on the second end 123.

Figure 5:
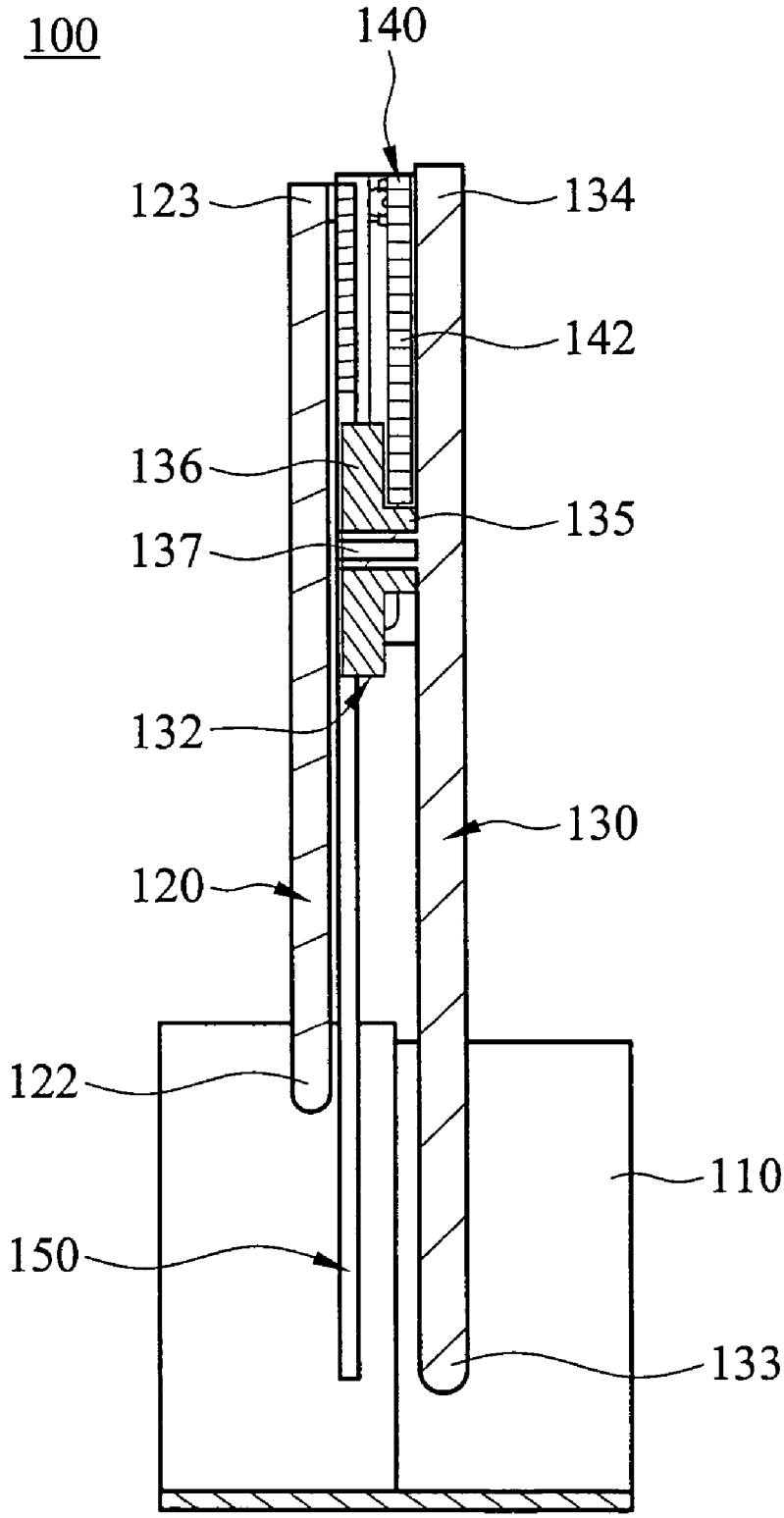
FIG. 5 is a schematic cross section taken along A-A of FIG. 4.
Figure 6:
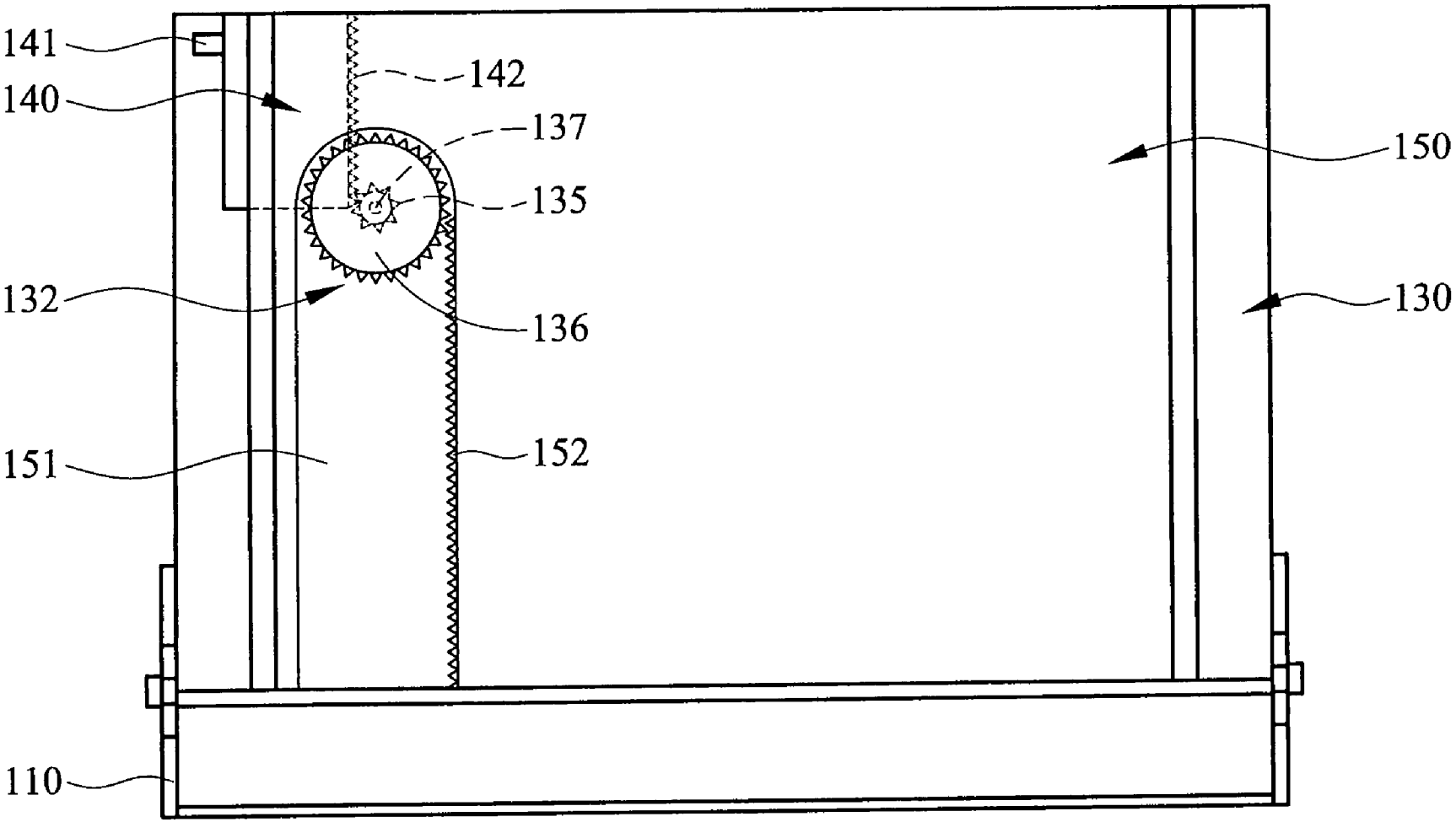
FIG. 6 is a schematic right side view without the first supporting member according to FIG. 1.

Referring to FIG. 5, the second supporting member 130 is rotatably connected to the fixed base 110 and has a sliding groove 131 and a gear set 132 fixed thereon. Specifically, the second supporting member 130 has a third end 133 and a fourth end 134. The third end 133 is rotatably connected to the fixed base 110. The sliding groove 131 is formed on the fourth end 134. Additionally, as shown in FIG. 5, the gear set 132 comprises a first gear 135 and a second gear 136 coaxially connected thereto. In this embodiment, the first gear 135 and second gear 136 are formed integrally. Specifically, the teeth and diameter of the first gear 135 are smaller than those of the second gear 136, as shown in FIG. 6. When the gear set 132 rotates, the circumferential distance run by the first gear 135 is smaller than that by the second gear 136.

Figure 3:
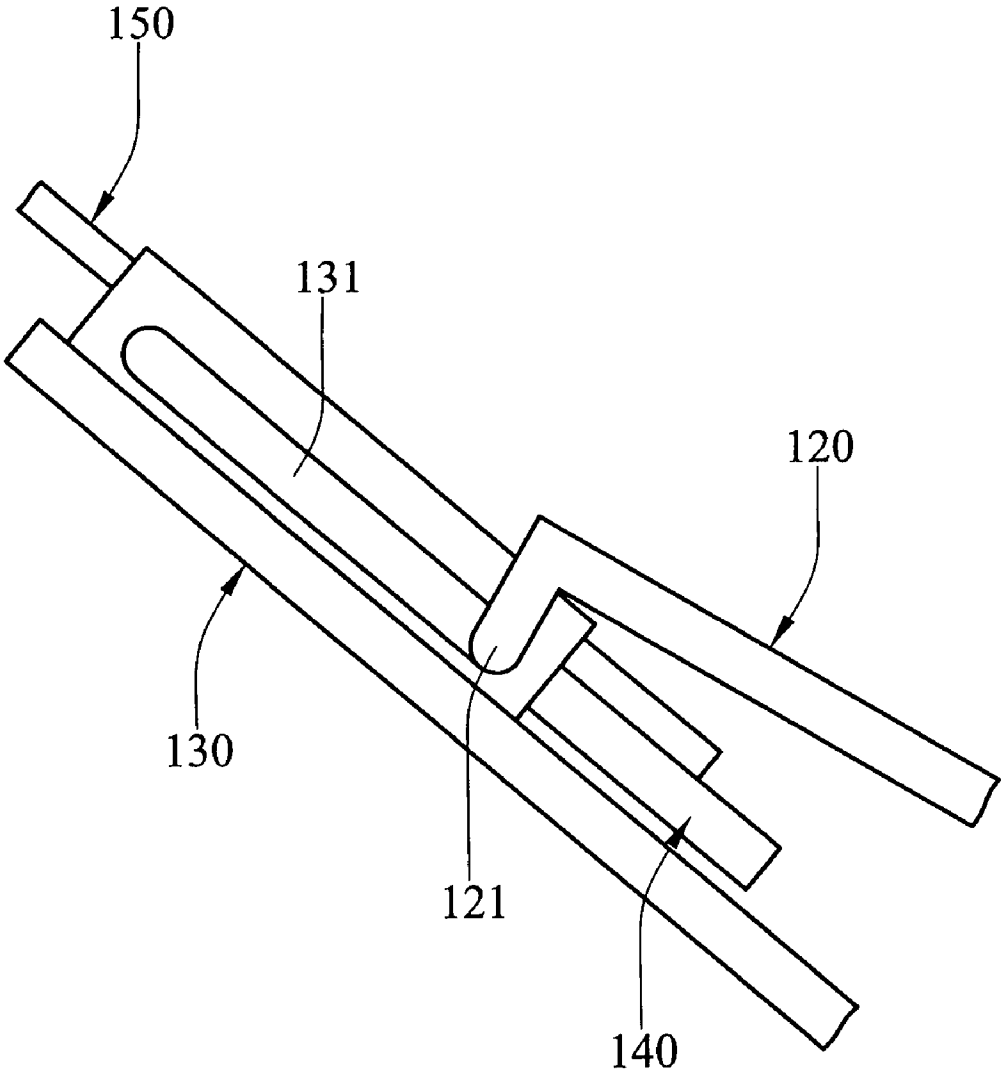
FIG. 3 is a partial enlarged view according to FIG. 2.
Figure 4:
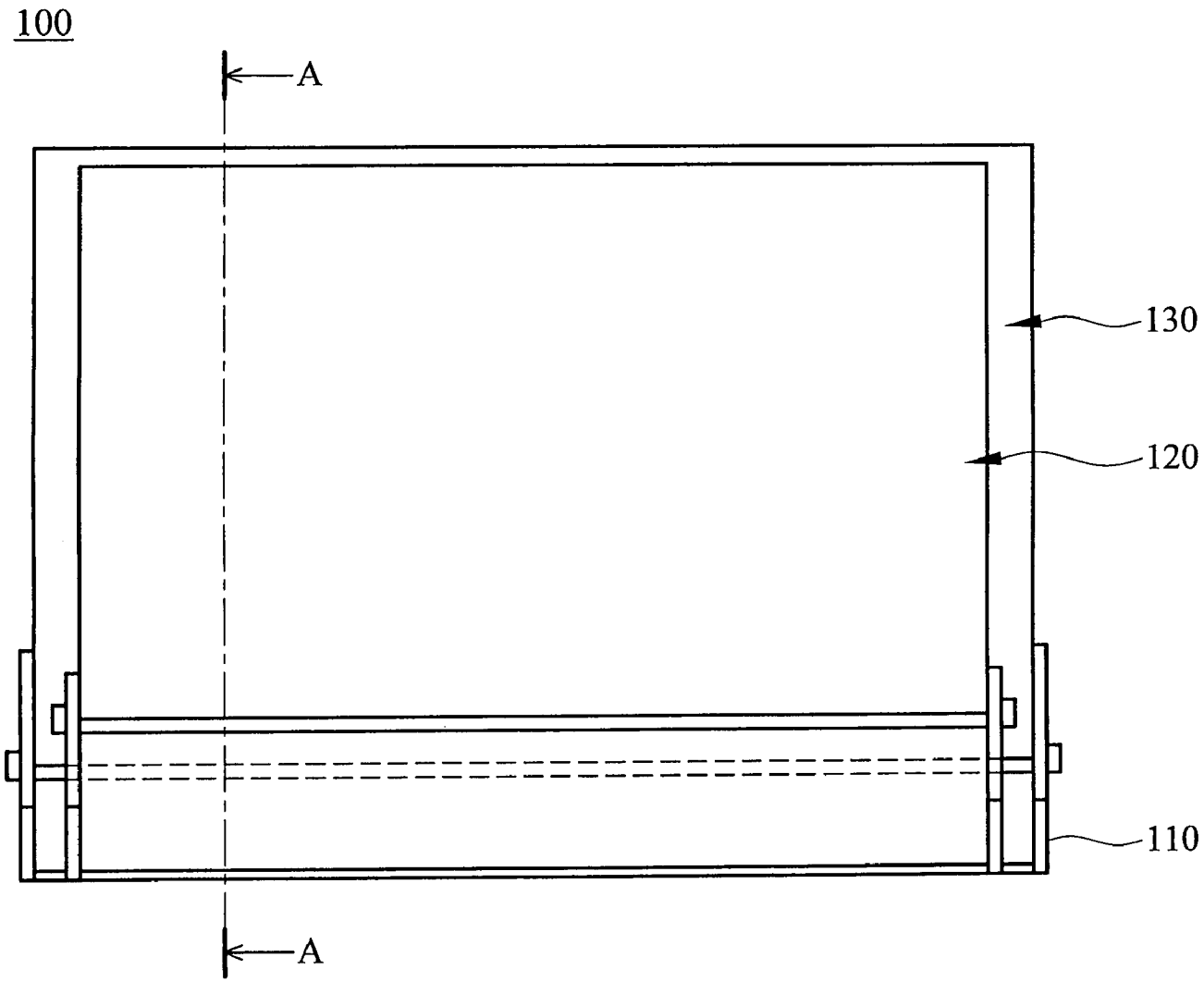
FIG. 4 is a schematic right side view according to FIG. 1.

As shown in FIG. 6, the guiding member 140 is disposed on the second supporting member 130 and has a guiding portion 141 and a first toothed portion 142. As shown in FIG. 3, the guiding portion 141 pivots to the sliding portion 121 of the first supporting member 120. The guiding portion 141 and sliding portion 121 simultaneously slide in the sliding groove 131 of the second supporting member 130. As shown in FIG. 5 and FIG. 6, the first toothed portion 142 of the guiding member 140 is a continuous toothed strip or rack and engages the first gear 135 of the second supporting member 130.

As shown in FIG. 6, the extendable supporting member 150 is disposed on the guiding member 140 and under the first supporting member 120. The extendable supporting member 150 comprises a guiding groove 151 and a second toothed portion 152 formed therein. Specifically, the second toothed portion 152 is formed on the inner wall of the guiding groove 151 and is a continuous toothed strip or rack. Additionally, the gear set 132 of the second supporting member 130 is in the guiding groove 151 of the extendable supporting member 150, and the second toothed portion 152 of the guiding groove 151 engages the second gear 136 of the gear set 132.

Accordingly, the first supporting member 120 and second supporting member 130 are rotatably connected to the fixed base 110. Namely, the first supporting member 120 is rotatably connected to the fixed base 110 by means of the first end 122 thereof while the second supporting member 130 is rotatably connected to the fixed base 110 by means of the third end 133 thereof. Specifically, the first end 122 is separated from the third end 133 by a predetermined distance.

When the first supporting member 120 and second supporting member 130 rotate, the extendable supporting member 150 can move between a received position I and an extended position II by movement of the guiding member 140 and transmission of the gear set 132. Specifically, the received position I is between the first supporting member 120 and the second supporting member 130 while the extended position II is outside the first supporting member 120 and second supporting member 130.

The following description is directed to the operation of the automatic support mechanism 100.

Figure 7:
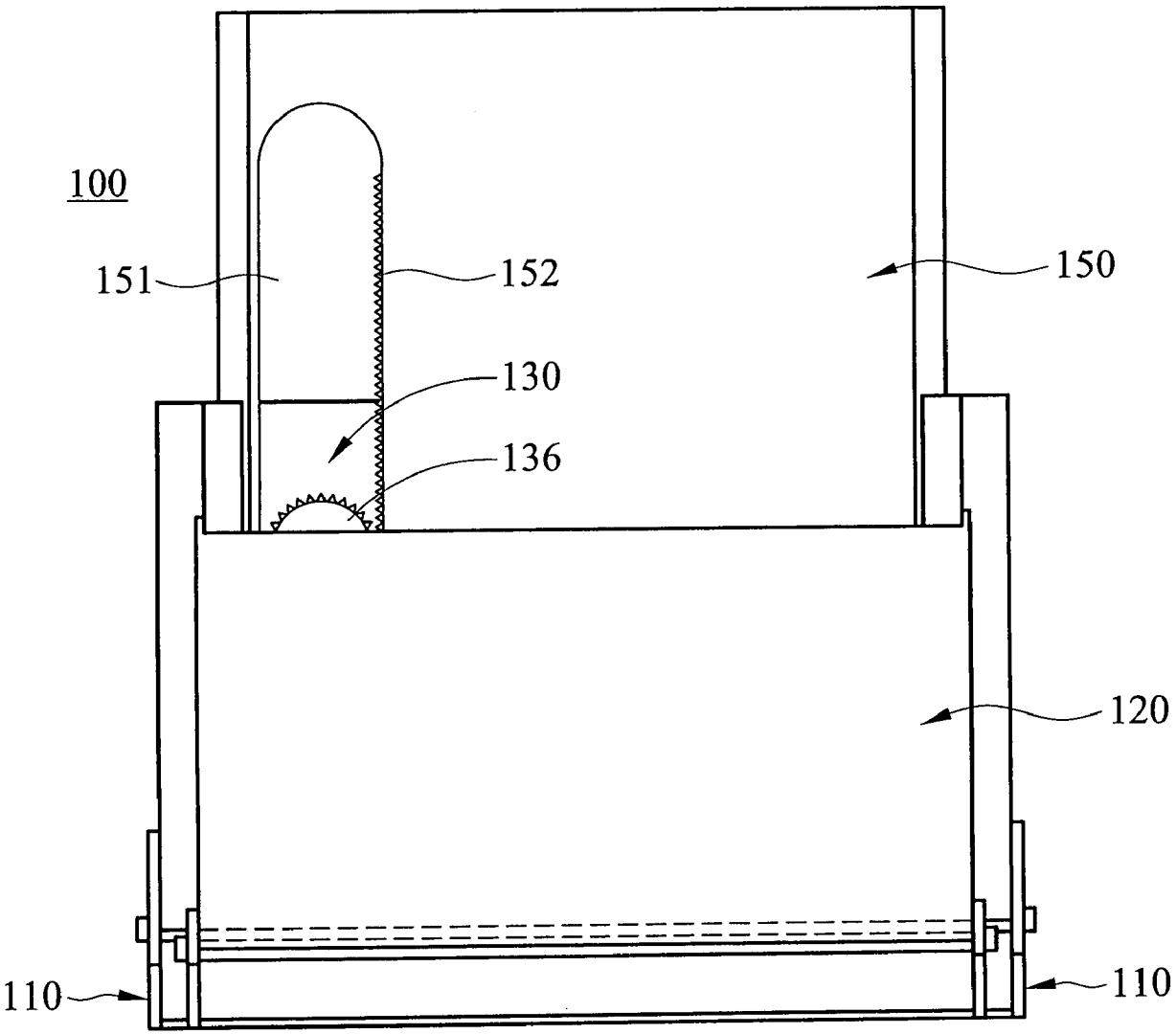
FIG. 7 is a schematic top view according to FIG. 2.

When the automatic support mechanism 100 extends, as shown in FIG. 1 and FIG. 2, the first supporting member 120 is rotated in a first direction D1 such that the sliding portion 121 of the first supporting member 120 and guiding portion 141 of the guiding member 140 slide in the sliding groove 131 of the second supporting member 130 in a second direction D2. At this point, the second supporting member 130 rotates in the first direction D1 and the guiding member 140 slides in the second direction D2. As shown in FIG. 6, due to the first toothed portion 142 of the guiding member 140 engaging the first gear 135 of the second supporting member 130 and the guiding member 140 sliding in the second direction D2, the first gear 135 then rotates counterclockwise and thereby the second gear 136 rotates counterclockwise. As shown in FIGS. 2, 5 and 6, the second toothed portion 152 of the guiding groove 151 of the extendable supporting member 150 engages the second gear 136 and the axle 137 of the first gear 135 and second gear 136 is fixed on the second supporting member 130. As shown in FIG. 2 and FIG. 7, the second gear 136 rotating counterclockwise thus moves the second toothed portion 152 of the guiding groove 151 in a third direction D3 until the extendable supporting member 150 moves outside the first supporting member 120 and second supporting member 130 in the third direction D3. At this point, the automatic extension of the automatic support mechanism 100 is complete.

When the automatic support mechanism 100 retracts, as shown in FIG. 1 and FIG. 2, the second supporting member 130 is rotated in a fourth direction D4 such that the sliding portion 121 of the first supporting member 120 and guiding portion 141 of the guiding member 140 slide in the sliding groove 131 of the second supporting member 130 in the third direction D3. At this point, the first supporting member 120 rotates in the fourth direction D4 and the guiding member 140 slides in the third direction D3. As shown in FIG. 2 and FIG. 7, due to the first toothed portion 142 of the guiding member 140 engaging the first gear 135 of the second supporting member 130 and the guiding member 140 sliding in the third direction D3, the first gear 135 then rotates clockwise and thereby the second gear 136 rotates clockwise. Similarly, the second toothed portion 152 of the guiding groove 151 of the extendable supporting member 150 engages the second gear 136 and the axle 137 of the first gear 135 and second gear 136 is fixed on the second supporting member 130. The second gear 136 rotating clockwise thus moves the second toothed portion 152 of the guiding groove 151 in a second direction D2 until the extendable supporting member 150 moves to a position between the first supporting member 120 and the second supporting member 130 in the second direction D2. At this point, retraction of the automatic support mechanism 100 is complete.

Accordingly, the second direction D2 is opposite to the third direction D3 and the first direction D1 is opposite to the fourth direction D4.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An automatic support mechanism, comprising:

a fixed base;

a first supporting member rotatably connected to the fixed base;

a second supporting member rotatably connected to the fixed base and slidably connected to the first supporting member;

an extendable supporting member movably disposed between the first supporting member and the second supporting member, wherein the extendable supporting member automatically moves between a received position and an extended position by relative rotation and sliding of the first and second supporting members; and a guiding member disposed on the second supporting member and having a guiding portion and a first toothed portion.

2. The automatic support mechanism as claimed in claim 1, wherein the first supporting member further comprises a sliding portion and the second supporting member further comprises a sliding groove and a gear set, the guiding portion of the guiding member pivoting to the sliding portion and sliding in the sliding groove, and the first toothed portion of the guiding member engaging the gear set.

3. The automatic support mechanism as claimed in claim 2, wherein the extendable supporting member further comprises a guiding groove and a second toothed portion formed therein, the gear set of the second supporting member in the guiding groove and engaging the second toothed portion, and the extendable supporting member moving between the received position and the extended position by transmission of the guiding member and gear set.

4. The automatic support mechanism as claimed in claim 3, wherein the gear set further comprises a first gear and a second gear coaxially connected thereto, the first toothed portion of the guiding member engaging the first gear, and the second toothed portion of the guiding groove engaging the second gear.

5. The automatic support mechanism as claimed in claim 4, wherein the first and second gears are formed integrally.

6. The automatic support mechanism as claimed in claim 4, wherein the teeth and diameter of the first gear are smaller than those of the second gear.

7. The automatic support mechanism as claimed in claim 1, wherein the first toothed portion of the guiding member is a continuous toothed strip or rack.

8. The automatic support mechanism as claimed in claim 3, wherein the second toothed portion of the guiding groove is a continuous toothed strip or rack.

9. The automatic support mechanism as claimed in claim 2, wherein the first supporting member further comprises a first end and a second end and the second supporting member further comprises two ends, the first end is connected to the fixed base, the sliding portion is formed on the second end, the sliding groove is formed on one end of the two ends of the second supporting member, and the other end of the two ends of the second supporting member is connected to the fixed base.

10. The automatic support mechanism as claimed in claim 9, wherein the first end is separated from the other end of the two ends of the second supporting member by a predetermined distance.

11. The automatic support mechanism as claimed in claim 1, wherein the received position is between the first supporting member and the second supporting member.

12. The automatic support mechanism as claimed in claim 1, wherein the extended position is outside the first and second supporting members.

* * * * *